US010844300B2

(12) United States Patent
Vreugdenhil et al.

(10) Patent No.: US 10,844,300 B2
(45) Date of Patent: Nov. 24, 2020

(54) REACTOR FOR PRODUCING A PRODUCT GAS FROM A FUEL

(71) Applicant: Stichting Energieonderzoek Centrum Nederland, Petten (NL)

(72) Inventors: Berend Joost Vreugdenhil, Petten (NL); Abraham van der Drift, Petten (NL)

(73) Assignee: MILENA-OLGA Joint Innovation Assets B.V., Maassluis (NL)

( * ) Notice: Subject to any disclaimer, the term of this patent is extended or adjusted under 35 U.S.C. 154(b) by 0 days.

(21) Appl. No.: 15/534,495

(22) PCT Filed: Dec. 7, 2015

(86) PCT No.: PCT/EP2015/078876
§ 371 (c)(1),
(2) Date: Jun. 9, 2017

(87) PCT Pub. No.: WO2016/091828
PCT Pub. Date: Jun. 16, 2016

(65) Prior Publication Data

US 2017/0362520 A1 Dec. 21, 2017

(30) Foreign Application Priority Data

Dec. 11, 2014 (NL) ..... 2013957

(51) Int. Cl.

| | |
|---|---|
| ***C10J 3/66*** | (2006.01) |
| ***C10J 3/72*** | (2006.01) |
| ***C10J 3/48*** | (2006.01) |
| ***C10J 3/46*** | (2006.01) |

(52) U.S. Cl.
CPC ..... *C10J 3/66* (2013.01); *C10J 3/466* (2013.01); *C10J 3/48* (2013.01); *C10J 3/485* (2013.01); *C10J 3/723* (2013.01); *C10J 2300/0959* (2013.01)

(58) Field of Classification Search
CPC ..... C10J 3/66
USPC ..... 423/650
See application file for complete search history.

(56) References Cited

U.S. PATENT DOCUMENTS

| | | | | |
|---|---|---|---|---|
| 4,548,138 | A | 10/1985 | Korenberg | |
| 5,980,858 | A * | 11/1999 | Fujimura | C10J 3/56 252/373 |
| 6,669,822 | B1 | 12/2003 | Fujimura et al. | |

(Continued)

FOREIGN PATENT DOCUMENTS

| | | | |
|---|---|---|---|
| EP | 0227550 | A2 | 7/1987 |
| JP | 2004-292540 | A | 10/2004 |

(Continued)

*Primary Examiner* — Douglas B Call
(74) *Attorney, Agent, or Firm* — N.V. Nederlandsch Octrooibureau; Catherine A. Schultz; Katelyn J. Bernier

(57) ABSTRACT

Method and reactor for producing a product gas from a fuel. The fuel is input into a pyrolysis chamber (6) and a pyrolysis process is executed for obtaining a product gas. Parts of the fuel exiting from the pyrolysis chamber (6) are recirculated to a combustion chamber (20, 23). In the combustion chamber (20, 23) a gasification process is executed in a fluidized bed (20) using a primary process fluid, followed by a combustion process in an area (23) above the fluidized bed (20) using a secondary process fluid.

7 Claims, 2 Drawing Sheets

(56) References Cited

U.S. PATENT DOCUMENTS

Figure 3:
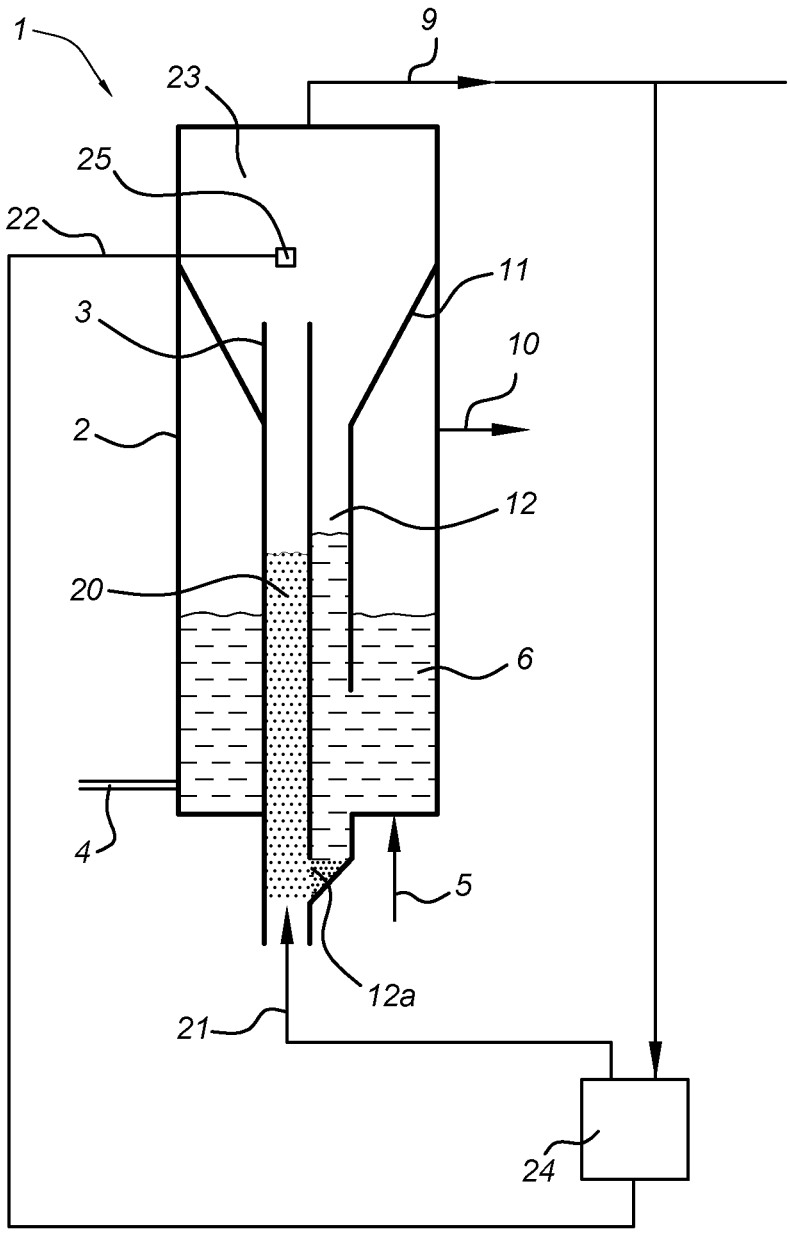

| | | | | |
|---|---|---|---|---|
| 2011/0223548 | A1* | 9/2011 | Fan | F23N 1/022 431/12 |
| 2012/0266793 | A1* | 10/2012 | Bohlig | F23G 5/027 110/342 |
| 2013/0195727 | A1* | 8/2013 | Bull | B01J 8/1809 422/139 |

FOREIGN PATENT DOCUMENTS

| | | | |
|---|---|---|---|
| WO | 01/96783 | A1 | 6/2001 |
| WO | 02/46331 | A1 | 6/2002 |
| WO | 2009/115784 | A2 | 9/2009 |
| WO | 2014092447 | A1 | 6/2014 |

* cited by examiner

Fig. 1 - Prior Art -
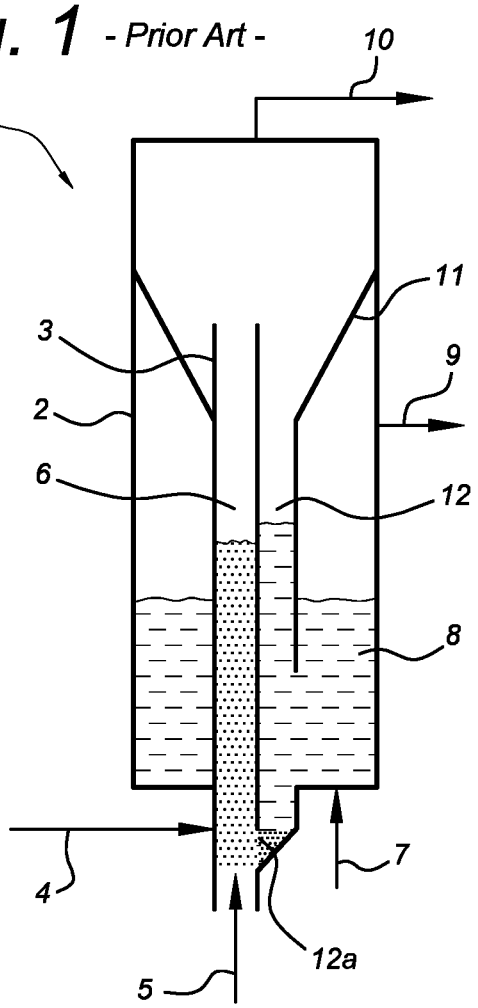
Fig. 2
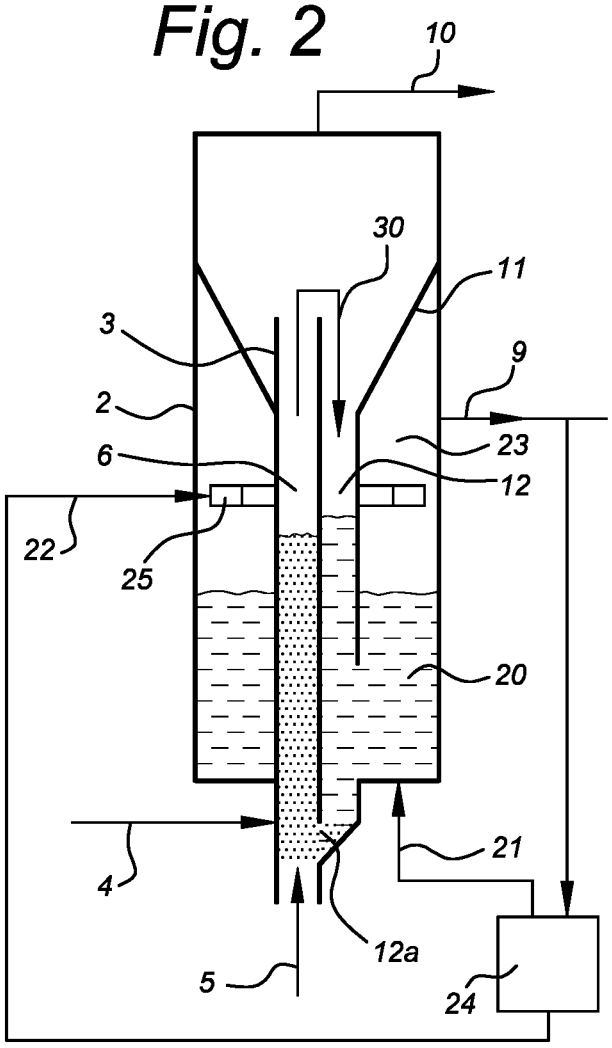

REACTOR FOR PRODUCING A PRODUCT GAS FROM A FUEL

FIELD OF THE INVENTION

The present invention relates to a method for producing a product gas from a fuel, comprising inputting the fuel into a pyrolysis chamber and executing a pyrolysis process for obtaining a product gas, and recirculating parts of the fuel exiting from the pyrolysis chamber to a combustion chamber. In a further aspect, a reactor for producing a product gas from a fuel is provided, comprising a pyrolysis chamber connected to a fuel input, a first process fluid input, and a product gas output, a combustion chamber connected to a flue output, and a feedback channel connecting the pyrolysis chamber and the combustion chamber.

PRIOR ART

International patent publication WO2014/070001 discloses a reactor for producing a product gas from a fuel having a housing with a combustion part accommodating a fluidized bed in operation, a riser extending along a longitudinal direction of the reactor, and a downcomer positioned coaxially around the riser and extending into the fluidized bed. One or more feed channels for providing the fuel to the riser are provided.

SUMMARY OF THE INVENTION

The present invention seeks to provide an improved reactor for processing fuels, such as biomass, waste or coal.

According to a first aspect of the present invention, a method according to the preamble defined above is provided, further comprising in the combustion chamber executing a gasification process in a fluidized bed using a primary process fluid, followed by a combustion process in an area above the fluidized bed using a secondary process fluid. The primary and secondary process fluids are e.g. air comprising oxygen. By creating a pyrolysis process, gasification process and combustion process separately several benefits can be achieved, including a more efficient operation and more ability to adapt to a specific fuel.

In a second aspect, the present invention relates to a reactor as defined in the preamble above, wherein the combustion chamber comprises a gasification zone accommodating a fluidized bed, and a combustion zone above the fluidized bed, wherein the reactor further comprises a primary process fluid input in communication with the gasification zone, and a secondary process fluid input in communication with the combustion zone. This allows to control the gasification process and combustion process separately, and more in particular the temperatures in several parts of the reactor, in order to achieve a more efficient all over operation and control of the reactor.

SHORT DESCRIPTION OF DRAWINGS

The present invention will be discussed in more detail below, using a number of exemplary embodiments, with reference to the attached drawings, in which FIG. 1 shows a schematic view of a prior art reactor for producing a product gas from a fuel;

FIG. 2 shows a schematic view of a reactor according to an embodiment of the present invention; and FIG. 3 shows a schematic view of a reactor according to a further embodiment of the present invention

DETAILED DESCRIPTION OF EXEMPLARY EMBODIMENTS

A device for producing a product gas from a fuel, such as biomass, is known in the prior art, see e.g. international patent publication WO2014/070001 of the same applicant as the present application. Fuel (e.g. biomass, waste or (low quality) coal) is supplied to a riser in a reactor and e.g. comprises 80% by weight of volatile constituents and 20% by weight of substantially solid carbon or char. Heating said fuel supplied to the riser to a suitable temperature in a low-oxygen, i.e. a substoichiometric amount of oxygen, or oxygen-free environment, results in gasification or pyrolysis in the riser. Said suitable temperature in the riser is usually higher than 800° C., such as between 850-900° C.

The pyrolysis of the volatile constituents results in the creation of a product gas. The product gas is, for example, a gas mixture which comprises CO, $H_2$, $CH_4$ and optionally higher hydrocarbons. After further treatment, said combustible product gas is suitable for use as a fuel for various applications. Due to the low gasification speed, the char present in the biomass will gasify in the riser merely to a limited extent. The char is therefore combusted in a separate zone (combustion part) of the reactor.

A cross sectional view of a prior art reactor 1 is shown schematically in FIG. 1. The reactor 1 forms an indirect or allothermic gasifier which combines pyrolysis/gasification for the volatile constituents and combustion for the char. As a result of indirect gasification, a fuel such as biomass, waste or coal is converted into a product gas which as end product or intermediate product is suitable as a fuel in, for example, boilers, gas engines and gas turbines, and as input for further chemical processes or chemical feedstock.

As shown in the schematic view of FIG. 1, such a prior art reactor 1 comprises a housing delimited by an external wall 2. At the top of the reactor 1 a product gas outlet 10 is provided. The reactor 1 further comprises a riser 3, e.g. in the form of a centrally positioned tube, forming a riser channel in its interior. One or more fuel inputs 4 are in communication with the riser 3 to transport the fuel for the reactor 1 to the riser 3. In the case the fuel is biomass, the one or more fuel inputs 4 may be fitted with Archimedean screws to transport the fuel towards the riser 3 in a controlled manner. The process in the riser 3 (which in the prior art embodiment is the pyrolysis process taking place in the pyrolysis chamber 6) is controlled using at the bottom a first process fluid input 5, e.g. for introducing steam. A feedback channel is provided from the top of the pyrolysis chamber 6 (or top of riser 3) back to a fluidized bed acting as a combustion chamber 8, e.g. in the form of a funnel 11 attached to a (coaxially positioned) return channel 12 and an aperture 12*a* towards the riser 3 at the lower side of the combustion chamber 8. The fluidized bed in the combustion chamber 8 is held 'fluid' using a primary process fluid input 7, e.g. using air. The space in the reactor 1 below the funnel 11 is in communication with a flue gas outlet 9.

However, in actual use, although the reactor 1 is capable of gasifying difficult (ash containing) fuels such as grass and straw, but also high ash coals and lignites, and waste, difficulties were observed in controlling the temperatures in the reactor 1. To achieve gasification of difficult fuels the temperature has to be lowered to avoid agglomeration and corrosion issues associated with the fuel. Normally what happens when lowering the gasification temperature is that the conversion to product gas also decreases. This results in more char, which ends up in the combustion chamber 8. In the fluid bed of the combustion chamber 8 the temperature will increase due to this effect and that is something which is not desired, because of the two above mentioned topics.

According to the present invention embodiments, of which embodiments are shown in the schematic views of FIG. 2 and FIG. 3, a reactor 1 is provided for producing a product gas from a fuel, comprising a pyrolysis chamber 6 connected to a fuel input 4, a first process fluid input 5, and a product gas output 10. A combustion chamber 20, 23 delimited by a wall 2 of the reactor 1 is provided, which combustion chamber is connected to a flue output 9, as well as a feedback channel 11, 12, 12*a* connecting the pyrolysis chamber 6 and the combustion chamber 20, 23. The combustion chamber comprises a gasification zone 20 accommodating a fluidized bed, and a combustion zone 23 above the fluidized bed. The reactor 1 further comprises a primary process fluid input 21 in communication with the gasification zone 20, and a secondary process fluid input 22 in communication with the combustion zone 23. Thus, in the present invention embodiments, an extra step is provided in the combustion chamber, namely gasification to improve its operating behavior. By creating a pyrolysis zone 6, gasification zone 20 and combustion zone 23 separately several benefits can be achieved.

Thus, in one further aspect of the invention, a method is provided for producing a product gas from a fuel, comprising inputting the fuel into a pyrolysis chamber 6 and executing a pyrolysis process for obtaining a product gas, recirculating (solid) parts of the fuel exiting from the pyrolysis chamber 6 to a combustion chamber 20, 23 (as depicted with line 30), and in the combustion chamber 20, 23 executing a gasification process in a fluidized bed 20 using a primary process fluid, followed by a combustion process in an area 23 above the fluidized bed 20 using a secondary process fluid. The primary and secondary process fluids are e.g. air comprising oxygen.

In order to achieve the separation between a gasification zone in the fluidized bed, and a combustion zone in the space of the reactor directly above the fluidized bed, the stoichiometry can be controlled, e.g. by operating the gasification process with an equivalence ratio ER between 0.9 and 0.99, e.g. 0.95, the equivalence ratio ER being defined as ratio of the amount of oxygen supplied divided by the amount of oxygen needed for complete combustion of the fuel supplied.

The primary process fluid input 21 is advantageously used for controlling the temperature in the fluidized bed 20, as this allows external steering of the processes inside the reactor 1. The equivalence ratio is e.g. controlled by reducing supply of the primary process fluid, reducing oxygen content in the primary process fluid, adding an inert gas to the primary process fluid, or by adding flue gas to the primary process fluid (e.g. from the flue output 9 (recirculation)). As all these alternatives are readily available, no or little additional effort and costs for construction and operation of the reactor 1 are needed.

The combustion zone 23 may be operated with an equivalence ratio ER of at least 1.2, e.g. equal to 1.3, in order to achieve a complete as possible combustion in the combustion zone, e.g. of the char produced by the pyrolysis process.

The primary and secondary process fluid input 21, 22 are arranged to provide air for a gasification and combustion process, respectively. This allows to control the gasification process and combustion process separately, in order to achieve a more efficient all over operation and control of the reactor 1. For efficient control, the reactor may comprise a control unit 24 (as shown in the embodiments of FIGS. 2 and 3) connected to the primary process fluid input 21 for controlling the velocity and oxygen content of a primary process fluid to the gasification zone 20. Furthermore, the control unit 24 may be connected to the secondary process fluid input 22 for controlling the velocity and oxygen content of a secondary process fluid to the combustion zone 23. Velocity and oxygen content may be controlled using an external air or other (inert) gas source, e.g. nitrogen, or in a further alternative, gas recirculation may be used using flue gas from the flue outlet 9. For this, the control unit 24 is e.g. provided with an input channel connected to the flue outlet 9 (and appropriate control elements, such as valves, etc.).

In a further embodiment of the present invention method the equivalence ratio is controlled based on measurement of a temperature in the product gas, and/or a temperature in the flue gas from the combustion process, and/or an oxygen content in the flue gas from the combustion process. E.g. to achieve the desired objective of an ER between 0.9 and 0.99 the measured oxygen content in the flue gas should be between 3-5%. These parameters may be readily measured in the reactor during operation, using suitable sensors which are known as such. In a further reactor embodiment the control unit 24 is connected to one or more sensors, e.g. temperature and/or oxygen content sensors.

In a further embodiment, the secondary process fluid input 22 comprises a distribution device 25 positioned in the combustion zone 23. This may achieve a better combustion result and efficiency in the combustion zone 23. The specific shape and structure may depend on the shape of the combustion zone, e.g. in the embodiment shown in FIG. 2, the distribution device may be a ring channel with distributed apertures. As an alternative, the distribution device 25 may be embodied as a plurality of tangentially positioned and inwardly directed nozzles distributed over the reactor wall 2 circumference.

To properly operate the pyrolysis process in the reactor, the first process fluid input 5 is arranged to provide a first process fluid, e.g. steam, $CO_2$, nitrogen, air, etc., to the pyrolysis chamber 6. The specific first process fluid parameters (such as temperature, pressure) may be externally controlled.

Difficult fuels can be gasified at lower than normal temperatures, while maintaining complete combustion. The heat normally associated with combustion is typically produced in the fluidized bed of the combustion chamber, but by lowering the stoichiometry of the combustion chamber and increasing the secondary air a gasification zone 20 is introduced. This gasification zone 20 can be tuned to raise or lower the temperature by adjusting the air to the fluidized bed via the primary process fluid input 21 (e.g. using (compressed) air). The combustion zone 23 above the fluidized bed is used to combust the unburnt components (CO and $C_xH_y$). The heat associated with this combustion will not increase temperature of the bubbling fluidized bed in gasification zone 20 and thus will not give rise to agglomeration issues.

By splitting the combustion chamber into a gasification zone 20 (bubbling fluidized bed, BFB) and a combustion zone 23 (above the BFB) part of the char will not be combusted and will be recycled back to the riser 3 (via aperture 12*a* of the feedback channel 11, 12). This will provide on the one hand an extra chance of steam gasification increasing the fuel conversion and on the other hand it can add to a catalytic process for tar reduction (char is known to have catalytic and/or adsorption activity).

There will be a build-up of char (especially at lower gasification temperatures), however, the fluidized bed of gasification zone 20 will break up the char in ever smaller particles, which eventually will escape to the combustion zone 23.

As an alternative, build-up of char can be prevented by increasing the velocity in the bubbling fluidized bed. This may be accomplished by reducing the size of the reactor 1 (most notably the diameter of the fluidized bed in gasification zone 20) and improve the scalability of the reactor 1. In further embodiments, the velocity is increased to create larger bubbles and a large splash zone in the bubbling fluidized bed in the gasification zone 20.

The secondary air in combustion zone 23 will then also burn char that is entering the area above the fluidized bed. This will create extra heat, which however is transported away via the flue outlet 9 and the fluidized bed temperature will remain low.

In FIG. 2 a variant of the reactor 1 is shown which is most suitable for processing biomass or waste (although other fuels may also be used). Here the pyrolysis chamber 6 is formed by one or more riser channels 3 positioned in the reactor 1 (e.g. in the form of a vertical tube, i.e. positioned lengthwise, or even coaxially to the reactor wall 2), and the bubbling fluidized bed is positioned in the gasification zone 20 in the bottom part of the reactor 1, surrounding the bottom part of the riser 3.

In comparison, the reactor 1 of FIG. 1 only comprises a pyrolysis chamber 6 and a combustion chamber 8 with a fluidized bed, where a combustion process takes place. In the variant of FIG. 2, the conditions in the fluidized bed in gasification zone 20 are adapted by lowering the equivalence ratio ER. As a result, by lowering the ER (ratio of an amount of oxygen supplied to an amount of oxygen needed for complete combustion) the volume flow goes down, as well as temperature in the fluidized bed in the gasification zone 20.

Similar improvements can be achieved in the variant of the reactor 1 as shown in the embodiment of FIG. 3. The operating principle is reversed from the embodiment of FIG. 2 (combustion now takes place in the riser 3 and the pyrolysis of the coal takes place in the fluidized bed 6). Or in other words, the combustion chamber 20, 23 is formed by one or more riser channels 3 positioned in the reactor 1. This embodiment can e.g. be advantageously used for processing low quality coal, e.g. having a high ash content.

In a further method embodiment (specifically for operating the reactor 1 embodiment of FIG. 3), the fluidized bed is operated with an equivalence ratio (ER) of at least 1, e.g. equal to 1.05 or equal to 1.1. The equivalence ratio (ER) is defined as the ratio of the amount of oxygen supplied divided by the amount of oxygen needed for complete combustion of the fuel. The present invention embodiments are capable of gasifying difficult (ash containing) fuels such as grass and straw, but also high ash coals and waste. However, to achieve gasification of difficult fuels the temperature is lowered to avoid agglomeration and corrosion issues associated with the fuel, as well as possible evaporation and fouling of downstream channels and installations by compounds like Pb, K, Cd, etc. Normally what happens when lowering the gasification temperature is that the conversion also decreases. This results in more char, which ends up in the combustor. In the prior art embodiment (fluidized bed in combustion chamber 8, see FIG. 1) the temperature will increase due to this effect and that is something which is not desired, because of the two above mentioned topics.

Lowering the combustion temperature is achieved by only partly combusting the fuel in the gasification zone 20 and realizing complete combustion in the combustion zone 23 above the fluidized bed. This is also where the additional heat is developed, which is not in direct contact with the ash components. Therefore, the ash is not evaporated and does not create a melting layer, causing agglomeration.

It was surprisingly found that it is possible of not having to achieve complete combustion in the fluidized bed. The unburnt parts of the fuel (CO and $C_xH_y$) are then used to achieve a high temperature and complete combustion.

The incomplete combustion of char in the fluidized bed may lead to a build-up of char. A possibility would be in a further embodiment to increase the splash zone of the bubbling fluidized bed in order to force char into the area above the fluidized bed, where it can then be combusted. This way, still sufficient char is converted to prevent accumulation (and a reduced efficiency). The increase in splash zone can only be achieved with larger velocities in the fluidized bed. This can be used for reducing the size (especially the diameter) of the reactor 1, which is good for scale up and for economics.

With respect to prior art embodiments of the reactor 1, the diameter of the reactor 1 according to the present invention embodiments may by reduced by a factor ⅔ or even less. The effects are as follows:

- Slight decrease in carbon conversion into flue gas, this means more of the fuel ends up in the product gas, and leads to a higher efficiency (This has been tested and observed).
- Better control on agglomeration effects, because the bed remains at low temperature. Tests have confirmed this.
- Better control on evaporation of alkalines and as a result better corrosion control. This has been confirmed in tests.
- Increased amounts of valuable products ($C_2$ and $C_3$ molecules and aromatics) at lower temperatures. Tests have confirmed this.
- Decrease in the amount of heavy tars (at lower temperatures), which ultimately are the ones causing problems in the connection to downstream equipment. Proven in tests.
- Decrease in the amount of heavy tars (char effect) at higher temperatures.
- Reduced equipment size. Since the fluidized bed can be fluidized with less air, the area of the bed can also be reduced. When operating at lower temperatures the area needs to be reduced further to maintain enough velocity. All of this improves the costs of an installation.
- Char that remains in the bubbling fluidized bed will have a few extra circulations rounds, adding to char conversion in the product gas, but also adding to perhaps catalytic and adsorption processes related to tar. (First at high temperature and the second at lower temperature).
- Scaling up the reactor 1 always raises the question of char distribution over the fluidized bed. For this purpose, the feedback channel may comprise one or more additional downcomer channels positioned in the reactor 1 in a further embodiment (similar to feedback or downcomer channel 12 as discussed in relation to FIG. 1-3 above). Additional downcomers 12 are possible at the expense of additional mechanical and thermal stress. It is noted however, that the present invention embodiments with an ER of lower than 1 makes the char distribution less critical, as gases are combusted above the fluidized bed, and gases mix better than solids.

Better emission control by staged combustion. Since there is a hot zone created above the bed, undesired emissions (CO and $C_xH_y$) will be much better controlled.

The present invention embodiments have been described above with reference to a number of exemplary embodiments as shown in the drawings. Modifications and alternative implementations of some parts or elements are possible, and are included in the scope of protection as defined in the appended claims.

The invention claimed is:

1. Method for producing a product gas from a fuel, comprising inputting a fuel into a pyrolysis chamber and executing a pyrolysis process for obtaining a product gas from volatile constituents of the fuel, recirculating solid parts of the fuel exiting from the pyrolysis chamber to a combustion chamber, and in the combustion chamber executing a gasification process for the recirculating solid parts in a gasification zone accommodating a fluidized bed using a primary process fluid, wherein the gasification process is controlled by controlling a velocity and oxygen content of the primary process fluid, and wherein a combustion process is controlled by controlling a velocity and oxygen content of a secondary process fluid, followed by the combustion process in an area above the gasification zone accommodating the fluidized bed using the secondary process fluid, wherein the gasification process is operated with an equivalence ratio ER between 0.9 and 0.99, the equivalence ratio ER being defined as the ratio of the amount of oxygen supplied divided by the amount of oxygen needed for complete combustion of the solid parts of the fuel supplied in the gasification zone, and wherein controlling the velocity and oxygen content of the primary process fluid and the secondary process fluid comprise increasing or decreasing the velocity and the oxygen content.

2. Method according to claim 1, wherein the gasification zone accommodating the fluidized bed is operated with an equivalence ratio ER of 0.99.

3. Method according to claim 1, wherein the primary process fluid is used for controlling a temperature in the fluidized bed.

4. Method according to claim 1, wherein the gasification process is controlled by one or more of:

reducing supply of the primary process fluid, reducing oxygen content in the primary process fluid, adding an inert gas to the primary process fluid, and/or adding a flue gas from the combustion process to the primary process fluid.

5. Method according to claim 4, wherein the gasification process is controlled based on measurement of a temperature in the product gas from the pyrolysis process.

6. Method according to claim 4, wherein the gasification process is controlled based on a temperature of the flue gas from the combustion process.

7. Method according to claim 4, wherein the gasification process is controlled based on an oxygen content in the flue gas from the combustion process.

* * * * *